US005092745A

United States Patent [19]

Graham

[11] Patent Number: 5,092,745

[45] Date of Patent: Mar. 3, 1992

[54] AUTOMATIC PRESSURE-DRIVEN COMPRESSOR

[76] Inventor: John M. Graham, 930 Peninsula Ave., San Mateo, Calif. 94403

[21] Appl. No.: 613,198

[22] Filed: Nov. 14, 1990

[51] Int. Cl.[5] ..... F04B 17/00; F04B 9/08; F01L 25/02

[52] U.S. Cl. ..... 417/401; 417/387; 91/307

[58] Field of Search ..... 417/401, 387; 91/304

[56] References Cited

U.S. PATENT DOCUMENTS

| | | | |
|---|---|---|---|
| 896,571 | 8/1908 | Ocain | 91/304 |
| 1,000,193 | 8/1911 | Post | 91/304 |
| 1,353,216 | 9/1920 | Carlson | 417/401 |
| 2,560,285 | 7/1951 | Habenicht | 91/304 |
| 3,007,415 | 12/1958 | Bessiere | 417/387 |
| 4,042,311 | 8/1977 | Yonezawa . | |
| 4,124,978 | 11/1976 | Wagner . | |
| 4,226,091 | 10/1980 | Nowacki . | |
| 4,348,161 | 9/1982 | Shibata . | |
| 4,593,668 | 6/1986 | Yuzawa | 417/304 |
| 4,681,678 | 7/1987 | Leaseburge | 417/401 |
| 4,769,988 | 9/1988 | Clark, Jr. . | |
| 4,779,427 | 10/1988 | Rowley et al. . | |
| 4,783,961 | 11/1988 | Walters . | |

*Primary Examiner*—Richard A. Bertsch

*Assistant Examiner*—Alfred Basichas

*Attorney, Agent, or Firm*—Townsend & Townsend

[57] ABSTRACT

A compressor (2) uses lower pressure compressed air from a compressed air supply (4, 6) to automatically create higher pressure compressed air. This compressor includes a pressure intensifier (8) having a piston assembly (16) sized for reciprocal movement between forward and retracted positions. The first cylinder (20) has an inlet (10) coupled to the air supply. The second cylinder (22) has an outlet (14) and a supplemental inlet (38). A first check valve (40) couples the supplemental inlet to the ambient atmosphere to permit fluid to flow through the first check valve and into the second cylinder through the supplemental inlet, but not the reverse. A second check valve (42) is coupled to the outlet and permits fluid to flow from the second cylinder, through the outlet and through the second check valve. The compressor also includes means for venting (48) the first cylinder to atmosphere when the piston assembly is in the forward position to permit the piston assembly to return to the retracted position. A shut-off valve (124) can be used to halt operation of the pressure intensifier when sufficient air pressure has been attained. A transfer valve (150) can be used to automatically permit air to flow from a high pressure tank (154) to a low pressure tank (152) when the presure level in the low pressure tank has dropped below a predetermined level.

28 Claims, 4 Drawing Sheets

AUTOMATIC PRESSURE-DRIVEN COMPRESSOR

BACKGROUND OF THE INVENTION

This invention relates to compressors, and particularly to a compressor for producing pressurized fluid at a high pressure from pressurized fluid at a low pressure.

Sometimes with devices such as hydraulic jacks, shearing machines and other hydraulically-operated devices, it is desirable to have pressurized fluid, typically compressed air, at two different pressures. This could be accomplished using a single compressor by providing air to a high pressure tank and connecting the high pressure tank through a pressure reducing valve to a low pressure tank. However, in some situations the compressor being used will only provide air at the lower pressure, not the higher pressure. It may not be economically feasible to change the lower pressure compressor for a higher pressure compressor or to purchase a supplemental, higher pressure compressor.

SUMMARY OF THE INVENTION

The present invention is directed to a compressor which uses a lower pressure fluid to automatically create a higher pressure fluid.

A compressor made according to the invention includes a pressure intensifier, first and second check valves, and a pressurized fluid supply. The pressure intensifier includes a housing and a piston assembly. The housing defines first and second cylinders such that the diameter of the first cylinder is longer than the diameter of the second cylinder. The piston assembly has first and second pistons coupled to one another, preferably by a common shaft. The pistons are sized for reciprocal movement within the first and second cylinders between forward and retracted positions First and second variable volumes are defined within the first and second cylinders as the piston assembly reciprocates within the housing. An inlet, which is coupled to the pressurized fluid supply, opens into the first volume of the housing, while an outlet and a supplemental inlet open into the second volume. The first check valve is coupled to the supplemental inlet such that fluid from, typically, the ambient atmosphere flows through the first check valve and into the second volume through the supplemental inlet. The first check valves could be connected to a pressurized fluid supply instead of the ambient atmosphere. The second check valve is coupled to the outlet such that fluid flows from the second volume, through the outlet and through the second check valve.

The compressor further includes means for coupling the first volume to a lower pressure exhaust region when the piston assembly is in the forward position to permit the piston assembly to return to the retracted position. The means for coupling preferably includes a relay valve, a special valve, and a valve element positioner. The relay valve has an inlet port coupled to the pressurized fluid supply, an outlet port coupled to the inlet, an exhaust port coupled to the exhaust region, typically the ambient atmosphere, and a control port. When the control port is in a high pressure state, the inlet port is coupled to the outlet port. When the control port is in a low pressure state, the outlet port is coupled to the exhaust port.

The special valve has a movable valve element within its interior. The special valve includes a first valve seat at a first valve opening which couples the interior to the pressurized fluid supply, a second valve seat at a second valve opening which couples the interior to the exhaust region, typically the ambient atmosphere, and a third valve opening which couples the interior to the control port. The valve element is normally biased to seat with the second valve seat.

A valve element positioning rod is carried by the piston assembly for reciprocal movement with the piston assembly. The end of the positioning rod is positioned external of the housing so to pass through the second valve opening when the piston assembly is in the forward position; this moves the valve element from the second valve seat to the first valve seat to couple the control port to the exhaust region and to place the control port at the low pressure state. This permits the pressurized air within the first volume to exhaust through the exhaust port of the relay valve. The piston assembly then moves back to the retracted position. When the piston assembly is moved to the retracted position, the positioning rod is also pulled away from the special valve to allow the movable valve element to seal the second valve opening to permit pressurized fluid from the pressurized fluid supply to flow to the control port to place the control port at the high pressure state so the cycle repeats.

In some applications, the compressor may also include a high pressure holding tank coupled to the second check valve for accepting fluid from the second volume. The holding tank may require a device for preventing over-pressure of the of the high pressure holding tank. A high pressure release valve may be coupled to the high pressure holding tank to prevent over-pressure. The pressure release valve may then be coupled either to the atmosphere or to the first volume coupling means. A shut-off valve, coupled to the high pressure holding tank, can also be placed between the pressurized fluid supply and the inlet of the pressure intensifier, to halt operation of the system when the pressure in the high pressure holding tank has reached a predetermined level.

The primary advantage of the compressor of the present invention is that it provides an automatic, simple system by which a fluid at a lower pressure may be used to drive an assembly to create a pressurized fluid supply at a higher pressure.

Often, several different tools or pieces of equipment are powered by a single compressor and air supply tank. For sake of economy, the compressor and air supply tank are generally sized so that the air supply tank is sufficient to meet normal day-to-day needs. However, at times many or most of the compressed air-using equipment and machines are operated at the same or closely spaced times; this can cause the pressure in the supply tank to drop faster than can be raised by the air compressor. Sometimes, this is merely an inconvenience and at other times it can be dangerous. The present invention can be very useful in these situation. The high pressure holding tank could be used for powering tools and equipment which require the high pressure air. The high pressure holding tank could also be connected to the main, low pressure supply tank by appropriate valving. When the main, low pressure tank drops below a certain pressure, it could be replenished quickly from the high pressure holding tank. Doing so can help reduce pressure fluctuations in the main, low pressure tank and can increase efficiency and safety without requiring an increase in the size of the main low pressure tank or capacity of the air compressor.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
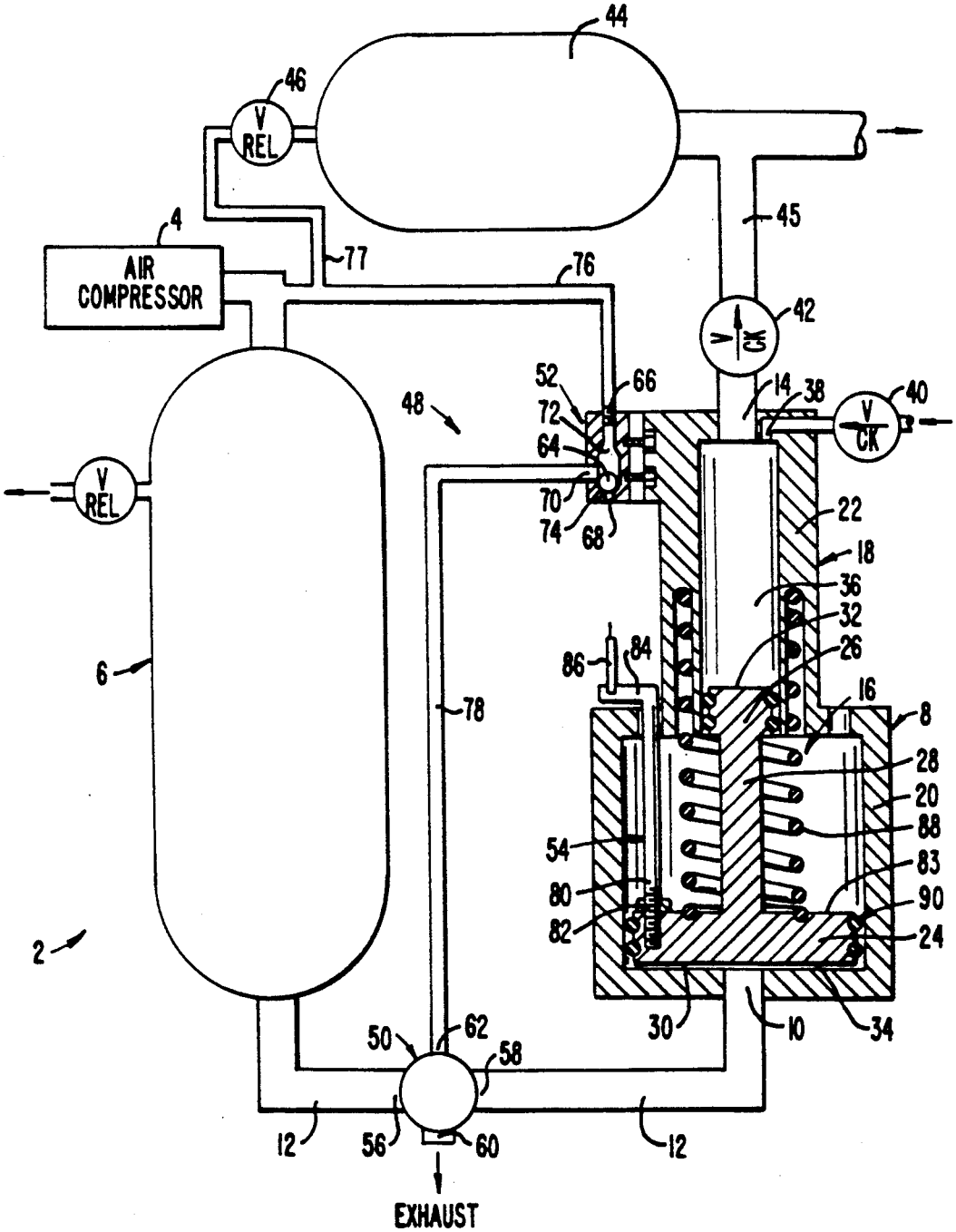
FIG. 1 is a simplified schematic representation of a compressor assembly made according to the present invention.

FIG. 1 depicts a first embodiment of the compressor assembly 2 of the present invention. The compressor assembly 2 includes an air compressor 4, which supplies air at approximately 75 to 125 psi to a low pressure holding tank 6. The low pressure holding tank 6 is coupled to a pressure intensifier 8 at inlet 10 by a fluid conduit 12. The low pressure air which enters the pressure intensifier 8 at inlet 10 is used to automatically convert low pressure air to high pressure air, at approximately 200 psi, which exits the pressure intensifier 8 at outlet 14 as is discussed below.

The pressure intensifier 8 includes a piston assembly 16 disposed within a housing 18. The housing 18 defines first and second cylinders 20 and 22 wherein the diameter of the first cylinder 20 is greater than the diameter of the second cylinder 22. Preferably, the first diameter is approximately three to four times the diameter of the second cylinder 22. The piston assembly 16 includes first and second pistons 24 and 26 which are mounted to a common shaft 28 such that a double piston assembly is formed. The first and second pistons 24 and 26 are sized for reciprocal movement within the first and second cylinders 20 and 22 between forward and retracted positions. As shown in FIG. 1, the piston assembly 16 is disposed in the retracted position such that the first piston 24 is disposed near the inlet 10 of the pressure intensifier 8. Conversely in the forward position, the second piston 26 is disposed near the outlet 14 of the pressure intensifier 8.

Pistons 24, 26 have first and second faces 30, 32 which define first and second variable volumes 34 and 36 within the first and second cylinders 20 and 22, respectively. The pressure intensifier 8 also includes a supplemental inlet 38 for supplying low pressure air to the second volume 36 of the second cylinder 22. The inlet 10 is defined at a surface of the first cylinder 20 opposite the first face 30 of the first piston 24. The outlet 14 and the supplemental inlet 38 are defined at a surface of the second cylinder 22 opposite the second face 32 of the second piston 26. The air is supplied by the atmosphere through a first check valve 40 in a way such that the air from the atmosphere flows through the first check valve 40 and into the second volume 36; first check valve 40 prevents the flow of air in the reverse direction. A second check valve 42 is coupled to the outlet 14 such that air flows from the second volume 36, through the outlet 14 and through the second check valve 42. Some of the high pressure air flowing through the second check valve 42 and a high pressure line 45 is stored in a high pressure holding tank 44. Tank 44 is coupled to a high pressure relief valve 46 to prevent overpressuring the tank.

The compressor assembly 2 also includes a first volume coupler 48 for coupling the first volume 34 to atmosphere when the piston assembly 16 is in the forward position to permit the piston assembly 16 to return to the retracted position. The coupler 48 includes a conventional relay valve 50, a special valve 52, and a valve element positioner 54. As shown in FIG. 1, the relay valve 50 has four ports: an inlet port 56, an outlet port 58, an exhaust port 60 and a control port 62. The inlet port 56 is coupled by the fluid conduit 12 to the low pressure holding tank 6, while the outlet port 58 is coupled by the fluid conduit 12 to the inlet 10 of the first volume 34 of the pressure intensifier 8. The exhaust port 60 is coupled to an exhaust region, which in this case is the atmosphere. The control port 62, which is coupled to the special valve 52, works by sealing the exhaust port 60 and coupling the inlet port 56 to the outlet port 58 when the control port 62 is in a high pressure state, and sealing the inlet port 56 and coupling the outlet port 58 to the exhaust port 60 when the control port 62 is in a low pressure state.

The special valve 52 includes a ball 64 which acts as a movable valve element within the interior of the special valve 52. The special valve 52 has first, second and third valve openings 66, 68 and 70. The first and second valve openings 66 and 68 have first and second valve seats 72 and 74, respectively, where the ball 64 may be seated. The first valve opening 66 is coupled to the air compressor 4 and tank 6 by supply line 76. The second valve opening 68 is coupled to the atmosphere. The third valve opening 70 is coupled to the control port 62 by control line 78. The ball 64 is normally biased to seat with the second valve seat 74, in the preferred embodiment by gravity.

Valve element positioner 54 is used to move the ball 64 between the second and first valve seats 72 and 74. Positioner 54 includes a positioning rod 80 having a first end 82 directed upward from and perpendicular to the second face 83 of the first piston 24 and a second end 84 disposed outside the housing 18. The second end 84 has a spring-loaded tip 86 to resiliently engage the ball 64.

The compressor assembly 2 may also include a return spring 88 which extends between the second cylinder 22 and the second face 32 of the first piston 24. During an upward stroke from the retracted to the forward position, the piston assembly 16 moves up against the force of the return spring 88. The return spring 88 is used for biasing the piston assembly 16 from the forward position to the retracted position. Additionally, the piston assembly 16 includes O-rings 90, preferably made of rubber, disposed along the circumference of the first and second pistons 24 and 26 for good seals when moving the piston assembly 16 between the forward and retracted positions.

In operation, the air compressor 4 simultaneously supplies low pressure air to the low pressure holding tank 6 and the special valve 52 through the first valve opening 66. While a common air compressor 4 is used in this embodiment, it is also possible to use a first air supply, other than the atmosphere, for supplying air to the second volume 36, a second air supply for supplying air to the low pressure holding tank 6, and a third air supply for supplying air to the first valve opening 66 of the special valve 52. Initially, the control port 62 will be in a high pressure state since the ball 64 is normally biased toward the second valve seat 74 and thus couples the first valve opening 66, which is coupled to the air compressor 4, through the third valve opening 70 to the control port 62. In a high pressure state, the inlet port 56 is coupled to the outlet port 58, thereby supplying low pressure air from the low pressure holding tank 6 into the first volume 34 through the inlet 10 of the pressure intensifier 8.

Supplying low pressure air into the first volume 34 causes the piston assembly 16 to move upward from the retracted position to the forward position In the retracted position, the first face 30 of the first piston 24 is disposed near the inlet 10. In the forward position, the second face 32 of the second piston 26 is disposed near the outlet 14. Due to the difference in the diameters of the first and second pistons 24 and 26, the air inside the second volume 36 compresses and thus increases in pressure as the piston assembly 16 moves into the forward position. Check valve 40 prevents the air from flowing through supplemental inlet 38 into the ambient atmosphere. If air compressor 4 is used to supply air into both the first and second volumes 34 and 36, the air pressure at the beginning of a stroke of the piston assembly 16 is the same in the first and second volumes 34 and 36. Also, the difference in the diameters of pistons 24, 26 could be less.

As higher pressure air is created in the second volume 36, this air moves through the second check valve 42 and into the high pressure holding tank 44 through high pressure line 45. The compressed air cannot flow back through the check valve 40 and thus passes into the high pressure conduit 45 through the second check valve 42. At the same time high pressure air is being generated, the valve element positioning means 54 moves upward with the piston assembly 16. In the forward position, the spring-loaded tip 86 of the second end 84 unseats the ball 64 from its normally biased position at the second valve seat 74. As soon as the ball 64 is moved from the second valve seat 74, air from the control line 78 begins exhausting through the second valve opening 68. When ball 64 is completely disposed in the first valve seat 72, air flow from the air compressor 4 through supply line 76 is halted. The control line 78 is coupled through the third valve opening 70 to the second valve opening 68, thus exhausting air into the atmosphere and creating a low pressure state at the control port 62.

In the low pressure state, the outlet port 58 is coupled to the exhaust port 60. Thus, the air in the first volume 34 exhausts through the inlet 10, the outlet port 58, the exhaust port 60 and into the atmosphere, thereby returning the piston assembly 16 to the retracted position. In the retracted position, the ball 64 moves back to the second valve seat 74. Air is once again supplied to the control port 62 through the first and third valve openings 66 and 70 and a high pressure state is created. Thus, the cycle repeats itself.

Lines 12, 45 are larger diameter lines, such as ⅜ inch inside diameter lines, since the operating air passes through them. The various control lines 76, 77, 78 can be smaller diameter lines, such as ⅛ inch inside diameter lines, since flow volume is not important.

To prevent overpressure of the high pressure holding tank 44, the high pressure release valve 46 is coupled to the tank 44. The high pressure release valve 46, as shown, is coupled to the supply line 76 by a connecting line 77. However, the high pressure release valve 46 may, alternatively, be coupled to the atmosphere.

Figure 2:
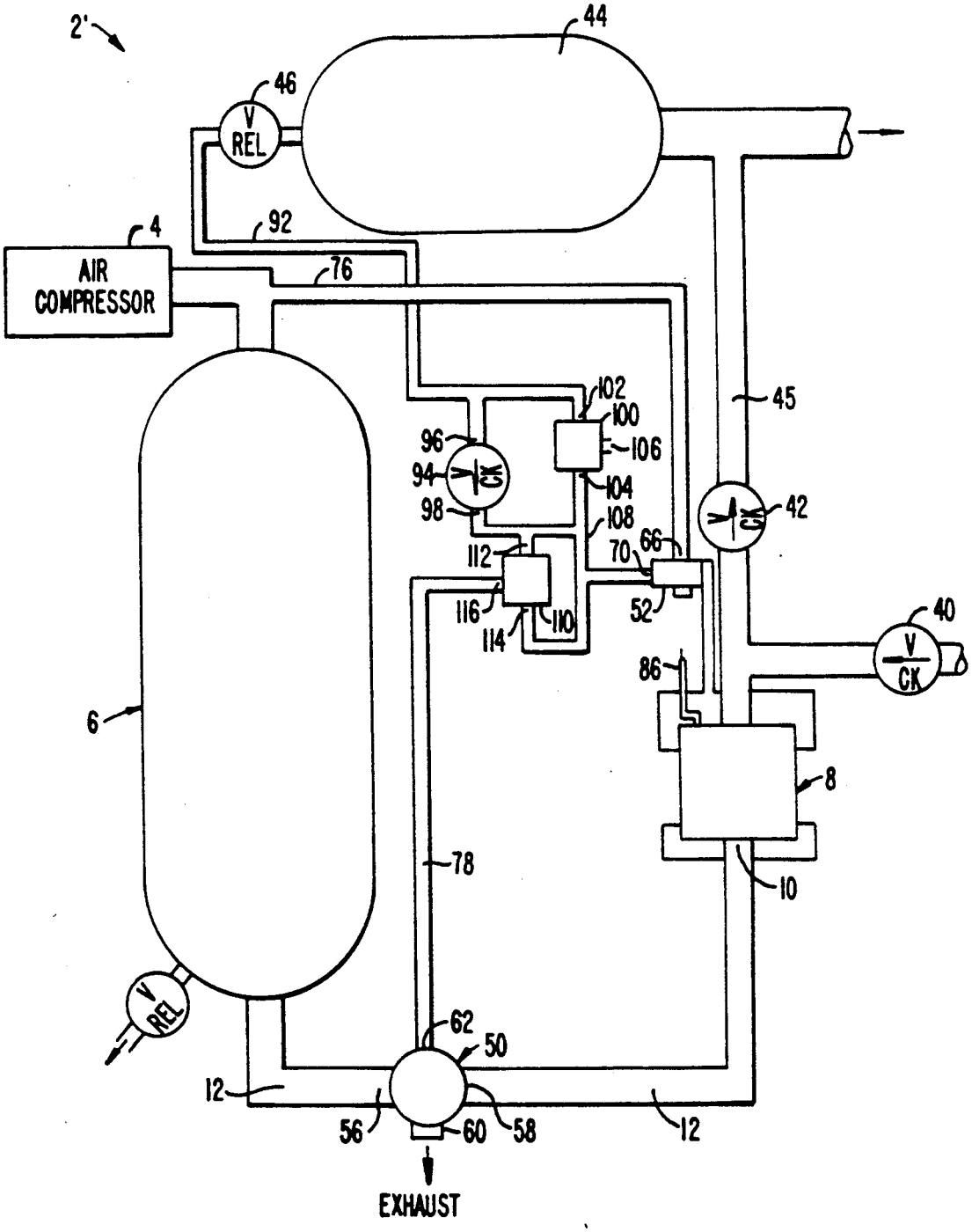
FIGS. 2 and 3 are simplified schematic representations of two alternative embodiment of the compressor assembly of FIG. 1 designed to halt operation of the pressure intensifier when the high pressure holding tank has reached its maximum pressure.

Compressor assembly 2 may be constructed to halt operation of the pressure intensifier 8 when the high pressure holding tank 44 has reached its maximum pressure. FIG. 2 shows a compressor assembly 2' similar to compressor assembly 2 with like parts referred to with like reference numerals. An output line 92 is separate from the control line 76, couples the high pressure release valve 46 to the inlet 96 of a third check valve 94 and to the control port 102 of a first pilot check valve 100. The first pilot check valve 100 includes control, inlet and exhaust ports 102, 104 and 106. The path from inlet port 104 to exhaust port 106 is sealed until the control port 102 has high pressure applied to it from an over-pressure release through line 92. When this occurs, the inlet and exhaust ports 104 and 106 are coupled together, which permits pressurized air within connector lines 108 (connected to the third valve opening 70 of special valve 52) to be exhausted through the exhaust port 106 of the first pilot check valve 100 to the atmosphere. Air also passes through the third check valve 94 to inlet port 104 and to the control port 112 of a second pilot check valve 110, thereby coupling the inlet and exhaust ports 114 and 116 of the second pilot check valve 110. As a result, air in the control line 78, which is coupled to the relay valve 50, is exhausted through the inlet and exhaust ports 114 and 116 of the second pilot check valve 110 to the connector lines 108.

The connector lines 108 couple the outlet 98 of the third check valve 94, the control and inlet ports 112 and 114 of the second pilot check valve 110, the third valve opening 70 of the special valve 52, and the inlet port 104 of the first pilot check valve 100. Thus, when the pressure within the high pressure holding tank 44 exceeds a desired level, the high pressure release valve 46 opens to permit air within the tank 44 to flow through the output line 92 to pressurize the control ports 102 and 112 of the first and second pilot check valve 100 and 110. As a result, air in the connector lines 108 exhausts through the inlet and exhaust ports 104 and 106 of the first pilot check valve 100 to the atmosphere, and the relay valve 50 is placed in the low pressure state. Simultaneously, air from the supply line 76 flows through the first and third valve openings 66 and 70 of the special valve 52, into the connector lines 108, and out the exhaust port 106 of the first pilot check valve 104. This stops the actuation of pressure intensifier 8 until the pressure in line 92 drops sufficiently to close inlet port 104.

Figure 3:
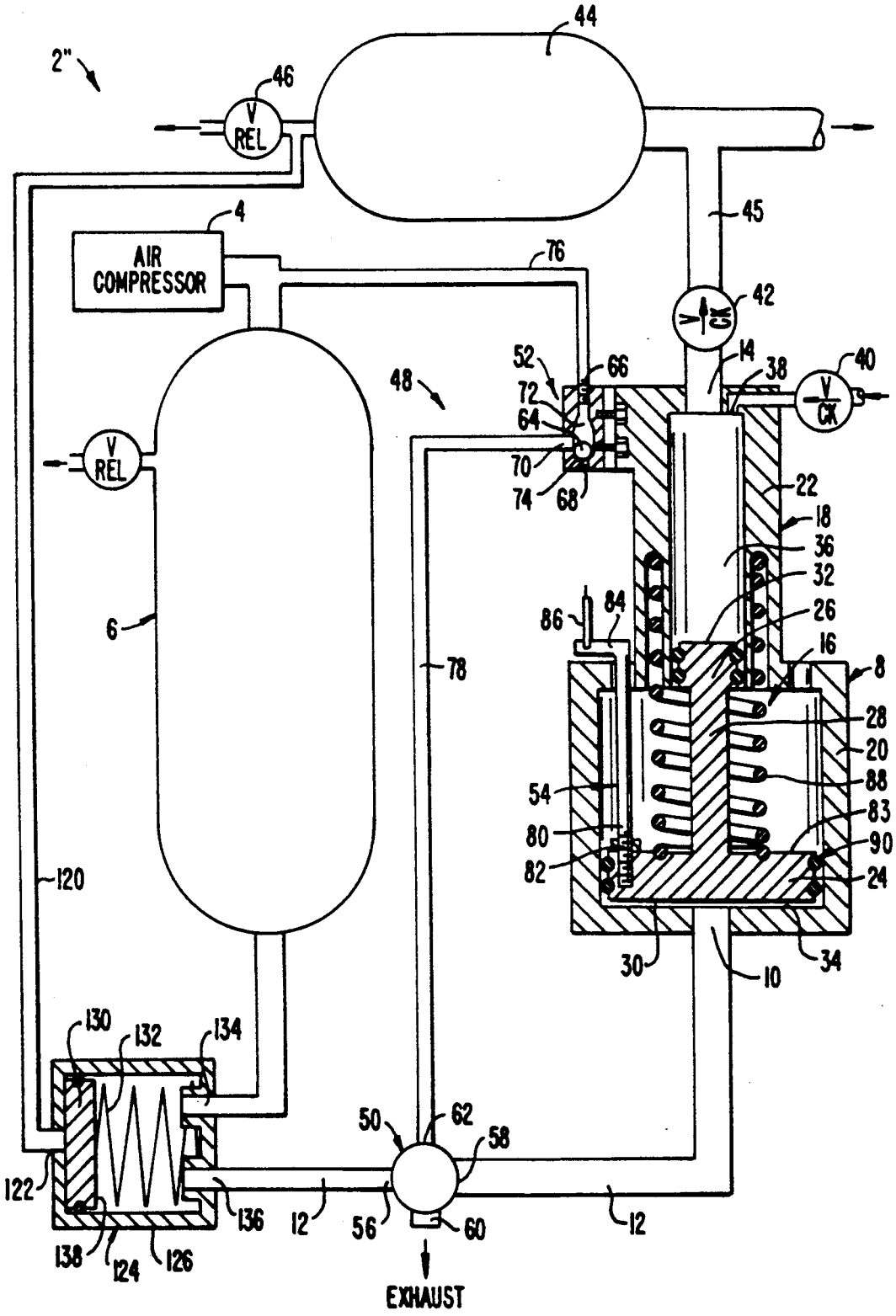

Turning now to FIG. 3, a compressor assembly 2" is shown. Assembly 2" is similar to pressure assembly 2 of FIG. 1 with the following main distinctions. Line 77 has been removed and high-pressure release valve 46 has been left to exhaust to atmosphere. Also, a connector line 120 is used to connect the interior of tank 44 to an inlet port 122 of a shutoff valve 124, indicated generally schematically in FIG. 3. Shutoff valve 124 includes a housing 126 having an interior 128 within which a piston 130 moves. Piston 130 is biased towards the position of FIG. 3 by a spring 132. Valve 124 also includes a pair of connecting ports 134, 136 coupled to line 12. Therefore, when piston 130 is in the position of FIG. 3, fluid flow along line 12 through shutoff valve 124 is unimpeded. Shutoff valve 124 is sized and configured so that when an overpressure exists in high pressure tank 44, piston 130 compresses spring 132 and forces the sealing face 138 of piston 130, typically made of an elastomeric material, against ports 134, 136 thus halting flow of air through conduit 12 from tank 6 to relay valve 50. This halts the operation of pressure intensifier 8 in an efficient and effective manner. By appropriate sizing of relief valve 46 and shutoff valve 124 so that shutoff valve 124 operates before relief valve 46 operates, air will generally never be dumped to atmosphere due to overpressure of tank 44. For example, assume that shutoff valve 124 is constructed to seal line 12 when the pressure within high pressure tank 44 is 205 psi and pressure relief valve is configured to open when the pressure supplied to it is 210 psi. Normally, shutoff valve 124 will halt the supply of air to pressure intensifier 8 before high pressure tank 44 reaches 210 psi so to make the operation efficient as well as safe.

Shutoff valve 124 could be modified to permit the force exerted by spring 132 against piston 130 to be adjusted. For example, a ring (not shown) could be mounted within interior 128 between spring 132 and housing 126 adjacent ports 134, 136. Studs could be used to adjust the axial position of the ring and thus change the force of spring 132 against piston 130.

Figure 4:
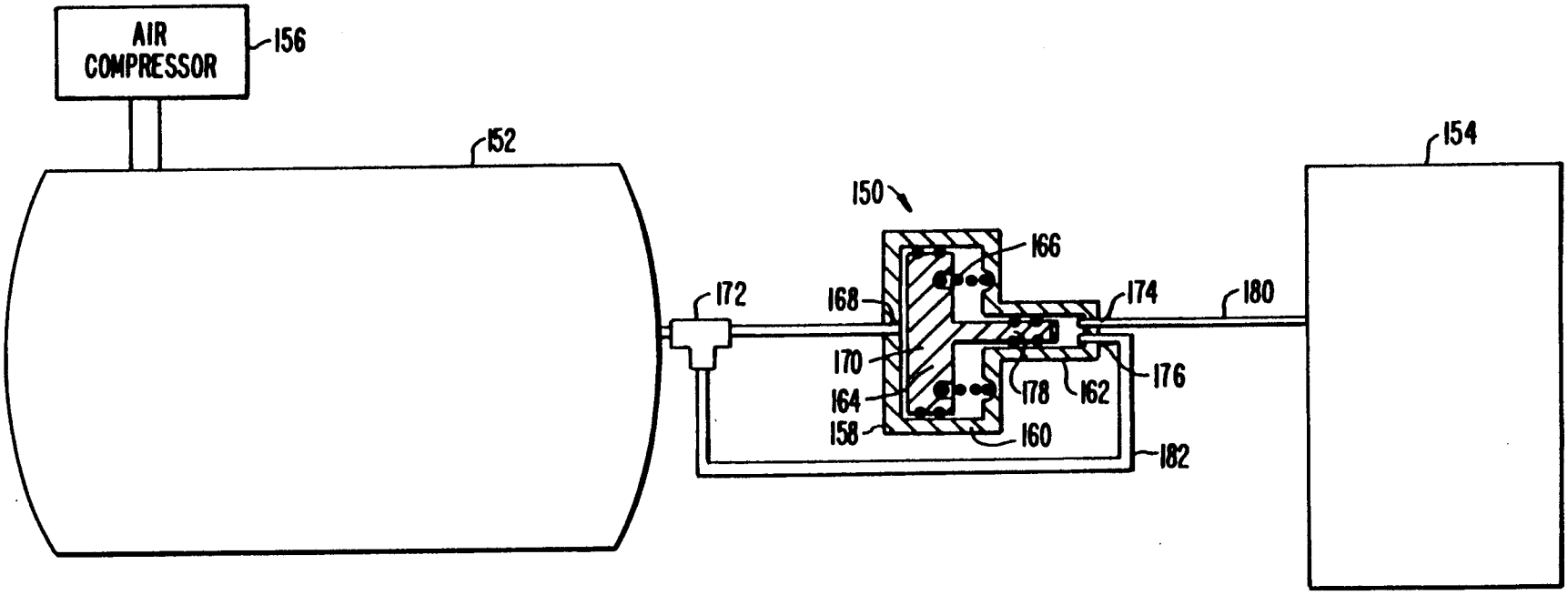
FIG. 4 is a schematic view of a transfer valve used to automatically supply a low pressure tank with air from a high pressure tank.

Often, a number of tools or pieces of equipment are powered by a compressor supplying air to an air supply tank such as air compressor 4 and tank 6. For sake of economy, the compressor and air supply tank are sized to meet the normal day-to-day needs. However, at times transient increased demand on the air supply tank may cause the pressure in the air supply tank to drop to an unacceptable level. FIG. 4 shows a transfer valve 150, coupling a low pressure tank 152 and a high pressure tank 154, designed to help remedy this situation. Tank 152 is provided air by an air compressor 156 while high pressure tank 154 could be provided with high pressure air using a pressure intensifier 8 or other means. Transfer valve 150 includes a valve body 158 having an enlarged cylinder 160 and a reduced cylinder 162. A double-ended piston 164 is mounted within cylinders 160, 162 for reciprocal movement therein. A spring 166 is used to bias piston 164 to the left in FIG. 4.

Valve body 158 includes a port 168 opposite a large end 170 of double-ended piston 164. Port 168 is coupled to low pressure tank 152 by a line 172. Valve body 158 also includes a pair of ports 174, 176 opposite a small end 178 of piston 164. Ports 174, 176 are coupled to high pressure tank 154 and line 172 by lines 180, 182 respectively. Ends 170, 178 of piston 164 and spring 166 are sized so that when low pressure tank 152 is within its normal operating range, such as 90–105 psi, the air pressure provided at port 168 is enough to overcome the force of pressure in line 180 and spring 166 acting on small end 178 so that piston 164 moves to the right in FIG. 4 to seal port 174. If, however, low pressure tank 152 drops below its lower operating pressure, for example below 90 psi, valve 150 is constructed so that double-ended piston 164 moves to the left in FIG. 4 opening port 174. This permits the high pressure air from tank 154 to pass through line 180, port 174, port 176, line 182, line 172 and into tank 152. This permits the low pressure tank 152 to be quickly and efficiently brought back up to at least its minimum operating pressure through the operation of transfer valve 150. Once a sufficiently high pressure is reached, piston 164 is forced again to the right to once again seal ports 174, 176.

If the brakes of air braked vehicles, such as trucks and busses, are applied repeatedly, as occurs in stop-and-go situations, the air brake supply tanks may be depleted below acceptable levels. However, by a simple modification of the vehicle to include a transfer value 150 with the compressor assembly of FIGS. 1 or 3, air in the air brake supply tank is automatically replenished from the high pressure tank; this problem can thus be eliminated or at least minimized.

As the pressure in tank 154 changes, the pressure at which piston 164 will unseat from ports 174, 176 will also change. For example, transfer valve 150 could be construed to actuate when tank 152 is below 90 psi when tank 154 is at 210 psi; if tank 154 drops to 180 psi, transfer valve 150 would actuate only when tank 152 is at a lower pressure, such as 80 psi. Using spring 166 helps to reduce the effect of variations in the pressure in high pressure tank 154 have on the pressure level at which valve 150 actuates. In some cases, it may be desirable to eliminate the use of spring 166, or to reposition bias piston 164 to the right in FIG. 4 by the appropriate sizing of ends 170, 178.

Modification and variation can be made to the disclosed embodiments without departing from the subject of the invention as defined in the following claims. For example, the present invention may use any low pressure fluid to generate a higher pressure fluid and is not just limited to applications with air. Pistons 24, 26 need not be connected directly by a common shaft; rather, the pistons could be coupled indirectly in a manner in which the length of stroke of one piston is not necessarily the same as the length of stroke of the other piston. Supplemental inlet 38 could be connected to task 6 instead of the ambient atmosphere; doing so would reduce the need for a large difference in diameters of the pistons. Two or more pressure intensifies could be placed in series to achieve higher pressures.

What is claimed is:

1. An automatic pressure-driven compressor, comprising:

a pressure intensifier including:

a housing defining first and second cylinders of first and second diameters, the first diameter different than the second diameter;

a piston assembly having first and second pistons connected together and sized for reciprocal movement within the first and second cylinders between forward and retracted positions, the first and second pistons having first and second faces defining first and second variable volume regions within the first and second cylinders as the piston assembly reciprocates within the housing; and the housing defining an inlet opening into the first volume, an outlet opening into the second volume and a supplemental inlet opening into the second volume;

a first check valve coupled to the supplemental inlet and configured to permit fluid to flow through the first check valve and into the second volume through the supplemental inlet;

a second check valve coupled to the outlet and configured to permit fluid to flow from the second volume, through the outlet and through the second check valve;

the first check valve coupling the supplemental inlet to a first fluid supply;

the inlet being coupled to a second, pressurized fluid supply; and means for coupling the first volume to a lower pressure exhaust region when the piston assembly is in the forward position to permit said piston assembly to return to the retracted position, the means for coupling including:

a relay valve having an inlet port coupled to the second fluid supply, an outlet port coupled to the inlet, an exhaust port coupled to the exhaust region, and a control port, the relay valve coupling the inlet port to the outlet port when the control port is in a high pressure state and coupling the outlet port to the exhaust port when the control port is in a low pressure state;

a special valve having a movable valve element, an interior housing the movable valve element, a first valve seat at a first valve opening coupling the interior to a third, pressurized fluid supply, a second valve seat at a second valve opening coupling the interior to the exhaust region, and a third valve opening coupling the interior to the control port, the valve element being normally biased to seat with the second valve seat; and valve element positioning means for moving the valve element from the second valve seat to the first valve seat when the piston assembly is in the forward position;

the movable valve element sealing the second valve opening when the piston assembly is in the retracted position to permit pressurized fluid from the third, pressurized fluid supply to be provided to the control port to place the control port at the high pressure state, the movable valve element sealing the first valve opening when the piston assembly is in the forward position so to couple the control port to the exhaust region through the third and second valve openings to place the control port at the low pressure state.

2. A compressor as recited in claim 1, wherein the first diameter is approximately four times as long as the second diameter.

3. A compressor as recited in claim 1, wherein the first diameter is approximately three times as long as the second diameter.

4. A compressor as recited in claim 1, wherein the inlet opening is defined at a surface of the first cylinder opposite the first face of the first piston, and the outlet opening and the supplemental inlet openings are defined at a surface of the second cylinder opposite the second face of the second piston.

5. A compressor as recited in claim 1, wherein the first fluid supply is at an ambient pressure.

6. A compressor as recited in claim 1, wherein the first fluid supply and the second fluid supply are at different pressures.

7. A compressor as recited in claim 1, wherein the piston assembly includes a spring for biasing the piston assembly from the forward position to the retracted position.

8. A compressor as recited in claim 1, wherein in the forward position the second face of the second piston is disposed near the outlet.

9. A compressor as recited in claim 1, wherein in the retracted position the first face of the first piston is disposed near the inlet.

10. A compressor as recited in claim 1, wherein the exhaust region is the atmosphere.

11. A compressor as recited in claim 1, wherein the first and second pistons are connected by a common shaft.

12. A compressor as recited in claim 1, wherein the valve positioning means includes a positioning rod including a first end directed upward from and perpendicular to the second face of the first piston and a second end disposed outside the housing.

13. A compressor as recited in claim 12, wherein the second end includes a spring-loaded tip resiliently engaging the movable valve element.

14. An automatic pressure-driven compressor assembly, comprising:

a first fluid supply;

a second, pressurized fluid supply;

a pressure intensifier including:

a housing defining first and second cylinders of first and second diameters, the first diameter different than the second diameter;

a piston assembly having first and second pistons coupled to one another and sized for reciprocal movement within the first and second cylinders between forward and retracted positions, the first and second pistons having first and second faces defining first and second variable volume regions within the first and second cylinders as the piston assembly reciprocates within the housing; and the housing defining an inlet opening into the first volume, an outlet opening into the second volume and a supplemental inlet opening into the second volume, the inlet coupled to the second fluid supply;

a first check valve coupling the supplemental inlet to the first fluid supply, the first check valve configured to permit fluid to flow from the fluid supply, through the first check valve and into the second volume through the supplemental inlet;

a second check valve coupled to the outlet and configured to permit fluid to flow from the second volume, through the outlet and through the second check valve;

a high pressure holding tank coupled to the second check valve for accepting the fluid from the second volume; and means for coupling the first volume to a lower pressure exhaust region when the piston assembly is in the forward position to permit said piston assembly to return to the retracted position.

15. A compressor assembly as recited in claim 14, further comprising means for halting the supply of fluid from the second fluid supply to the inlet when the high pressure holding tank is above a chosen pressure.

16. A compressor assembly as recited in claim 15, wherein the high pressure holding tank is coupled to a pressure release valve.

17. A compressor assembly as recited in claim 16, wherein the pressure release valve is coupled to the atmosphere.

18. A compressor assembly as recited in claim 16, wherein the pressure release valve is coupled to the first volume coupling means.

19. A compressor assembly as recited in claim 14, further comprising means for automatically fluidly coupling the high pressure holding tank to the second fluid supply when the pressure of the second fluid supply is less than a first predetermined valve relative to the pressure of the high pressure holding tank.

20. The compressor assembly as recited in claim 19 wherein the automatic fluid coupling means includes a transfer valve comprising:

a double-ended piston and cylinder assembly having a first and second pistons partially bounding first and second variable volume regions;

a first port, coupled to the high pressure holding tank, opening in the first variable volume region;

a second port, coupled to the second fluid supply, opening into the second variable volume region;

a third port, coupled to the second fluid supply, opening into the first variable volume region; and means for blocking fluid flow between the second and third ports by the first piston when the pressure of the second fluid supply is greater than a second predetermined value relative to the pressure of the high pressure holding tank, and for permitting fluid flow between the second and third ports by the first piston when the pressure of the second fluid supply is less than the first predetermined value relative to the pressure of the high pressure holding tank.

21. The compressor assembly as recited in claim 20 wherein the first and second predetermined pressures are about the same.

22. The compressor assembly as recited in claim 20 wherein the blocking means seals the third port when blocking fluid flow between the second and third ports.

23. An automatic pressure-driven compressor assembly, comprising:

a first fluid supply;

a second, pressurized fluid supply;

a pressure intensifier including:

a housing defining first and second cylinders of first and second diameters, the first diameter different than the second diameter;

a piston assembly having first and second pistons coupled to one another and sized for reciprocal movement within the first and second cylinders between forward and retracted positions, the first and second pistons having first and second faces defining first and second variable volume regions within the first and second cylinders as the piston assembly reciprocates within the housing; and the housing defining an inlet opening into the first volume, an outlet opening into the second volume and a supplemental inlet opening into the second volume, the inlet coupled to the second fluid supply;

a first check valve coupling the supplemental inlet to the first fluid supply, the first check valve configured to permit fluid to flow from the fluid supply, through the first check valve and into the second volume through the supplemental inlet;

a second check valve coupled to the outlet and configured to permit fluid to flow from the second volume, through the outlet and through the second check valve; and means for coupling the first volume to a lower pressure exhaust region when the piston assembly is in the forward position to permit said piston assembly to return to the retracted position, the first volume coupling means including:

a relay valve having an inlet port coupled to the second fluid supply, an outlet port coupled to the inlet, an exhaust port coupled to the exhaust region, and a control port, the relay valve coupling the inlet port to the outlet port when the control port is in a high pressure state and coupling the outlet port to the exhaust port when the control port is in a low pressure state;

a special valve having a movable valve element, an interior housing the movable valve element, a first valve seat at a first valve opening coupling the interior to a third, pressurized fluid supply, a second valve seat at a second valve opening coupling the interior to the exhaust region, and a third valve opening coupling the interior to the control port, the valve element being normally biased to seat with the second valve seat; and valve element positioning means for moving the valve element from the second valve seat to the first valve seat when the piston assembly is in the forward position;

the movable valve element sealing the second valve opening when the piston assembly is in the retracted position to permit pressurized fluid from the third pressurized fluid supply to be provided to the control port to place the control port at the high pressure state, the movable valve element sealing the first valve opening when the piston assembly is in the forward position so to couple the control port to the exhaust region through the third and second valve openings to place the control port at the low pressure state.

24. A compressor assembly as recited in claim 23, wherein the second and third fluid supplies are the same.

25. A compressor assembly as recited in claim 23, further comprising a high pressure holding tank coupled to the second check valve for accepting the fluid from the second volume.

26. A compressor assembly as recited in claim 23, wherein the high pressure holding tank is coupled to a pressure release valve.

27. A compressor assembly as recited in claim 26, wherein the pressure release valve is coupled to the atmosphere.

28. A compressor assembly as recited in claim 26, wherein the pressure release valve is coupled to the first volume coupling means.

* * * * *